US005158045A

United States Patent [19]

Arthur et al.

[11] Patent Number: 5,158,045

[45] Date of Patent: Oct. 27, 1992

[54] ENGINE INDUCTION SYSTEM HAVING A TELESCOPIC THROTTLE BODY

[75] Inventors: R. Edward Arthur, Chatham; Lisa Whaley, Staples; Stephen E. Brackett, Blenheim, all of Canada

[73] Assignee: Siemens Automotive Limited, Chatham, Canada

[21] Appl. No.: 831,781

[22] Filed: Feb. 5, 1992

[51] Int. Cl.[5] ..... F02M 35/10

[52] U.S. Cl. ..... 123/52 M; 123/52 MC; 123/337

[58] Field of Search ..... 123/337, 52 M, 52 MV, 123/52 MC, 52 MB, 432

[56] References Cited

U.S. PATENT DOCUMENTS 4,419,972 12/1983 Hattori et al. ..... 123/337

5,092,284 3/1992 Yamada ..... 123/52 MB

*Primary Examiner*—David A. Okonsky

*Attorney, Agent, or Firm*—George L. Boller; Russel C. Wells

[57] ABSTRACT

A throttle body has telescopically engaged parts that allows it to be telescopically contracted for insertion into the induction system at assembly and then telescopically expanded to secure its installation.

15 Claims, 2 Drawing Sheets

ENGINE INDUCTION SYSTEM HAVING A TELESCOPIC THROTTLE BODY

FIELD OF THE INVENTION

This invention relates to the induction system of an internal combustion engine, and more specifically to a telescopic throttle body for the induction system.

BACKGROUND AND SUMMARY OF THE INVENTION

In a typical induction system, the throttle body is disposed at a location between the air intake portion and the air distribution portion. The air intake portion typically contains a filter, and the air distribution portion typically contains a plenum, or manifold, with runners leading to the individual engine cylinders. A typical process for assembling the various parts of such an induction system together comprises mounting the throttle body on a plenum or manifold flange, and then connecting the air intake to the inlet of the throttle body. In order to minimize the extent of assembly operations that are required to fabricate an induction system, it has become desirable to integrate components.

The present invention relates to a throttle body of an induction system in which a portion of the induction system that is immediately upstream of the throttle body is integrated with a portion that is immediately downstream of the throttle body such that the throttle body must be fitted between mounting flanges that are spaced a fixed distance apart from each other. The present invention relates to a throttle body that can be expeditiously and reliably assembled into such an integrated system. Generally speaking, the present invention comprises a throttle body fabricated to have two telescopically engaged body parts that are selectively operable to a telescopically contracted condition and to a telescopically expanded condition. When its two body parts are in the telescopically contracted condition, the throttle body can be disposed between the two mounting flanges of the integrated system. The two parts are then operated to telescopically expanded condition to cause the inlet and outlet flanges of the throttle body to mate with the respective mounting flanges. A locking feature is also provided by the invention for the purpose of locking the two parts in telescopically expanded condition after the respective flanges have been mated. O-ring seals are provided between each pair of mated flanges so that a fluid-tight path for the induction flow is provided. There is also an O-ring seal between the two body parts. It is desirable to include a locking means that positively locks the two body parts in the telescopically expanded condition so that removal of the throttle body is prevented after it has been telescopically expanded and locked.

In a specific embodiment of the invention, camming means and cammed means are provided on the respective body parts for the purpose of operatively relating them such that when they are in telescopically contracted condition, relative rotation of one to the other about their co-axis will cause them to be telescopically expanded. A further feature related to the camming means and the cammed means is the provision of detent means defining the respective telescopically contracted and telescopically expanded conditions.

The present invention enables an integrated air-fuel system to be fabricated more efficiently and to be assembled with greater expediency, and it enables the throttle body to be quickly and properly located and assembled into the induction system. The invention is particularly suited for an induction system in which the throttle body must be disposed between two mounting flanges that are spaced a fixed distance apart, such as when the mounting flanges are integrated into a single part of the induction system, although it should be appreciated that the invention may be useful in other forms of induction systems.

Further features, advantages, and benefits of the invention, along with those already mentioned, will be seen in the ensuing description and claims which should be considered in conjunction with the accompanying drawings. The drawings illustrate a presently preferred embodiment of the invention according to the best mode contemplated at this time for carrying out the invention.

DESCRIPTION OF THE PREFERRED EMBODIMENT

Figure 1:
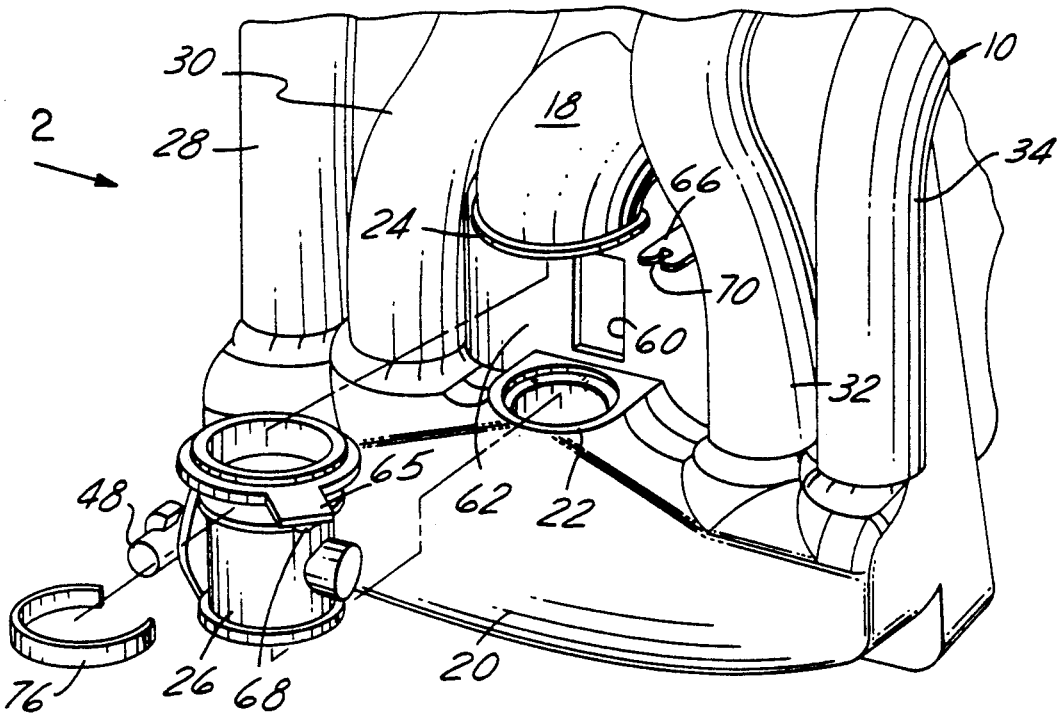
FIG. 1 is an exploded perspective view of a portion of an exemplary induction system including a throttle body according to principles of the invention.
Figure 2:
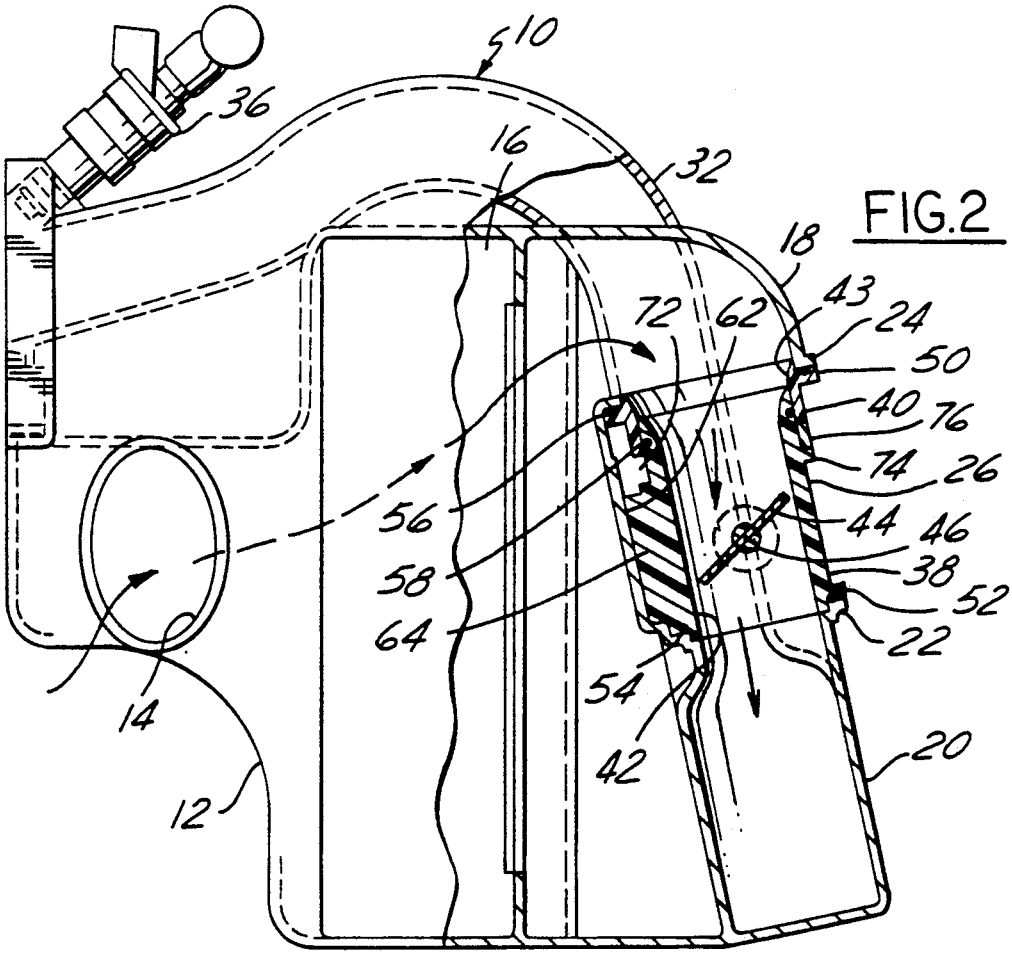
FIG. 2 is a left side elevational view, having a portion broken away, in the direction of arrow 2 in FIG. 1, but illustrating the throttle body having been assembled into the induction system.
Figure 4:
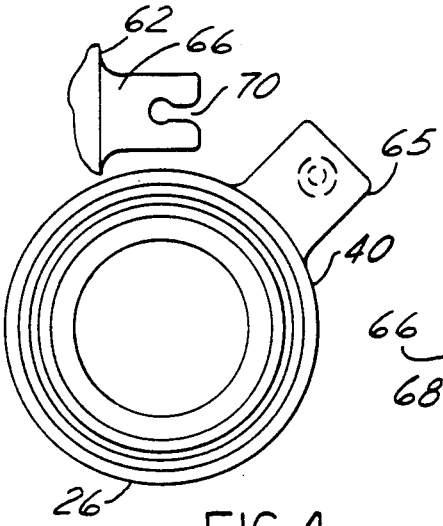
FIG. 4 is a top plan view of FIG. 3 and includes a portion of the induction system relating to the locking feature mentioned earlier.
Figure 7:
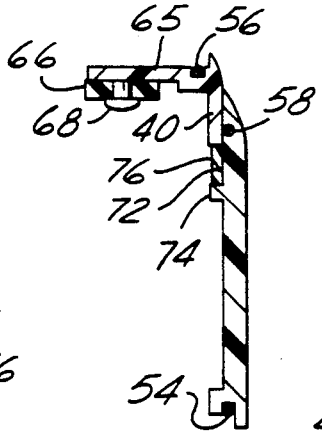
FIG. 7 is a fragmentary cross-sectional view taken in the direction of arrows 7—7 in FIG. 6.
Figure 6:
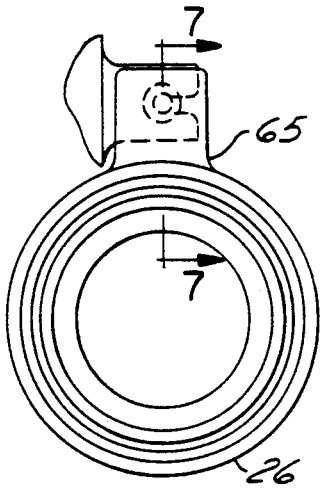
FIG. 6 is a top plan view of FIG. 5, and includes the locking feature shown in locking condition.

FIGS. 1 and 2 illustrate an exemplary induction system 10 of an internal combustion engine. The induction system comprises a member 12 having a fresh air entrance 14 through which inducted air enters for ensuing passage to and through a filtering zone 16 containing an air filter which is not expressly shown in the drawing figure. After inducted air has been filtered, it passes through an elbow 18 which is also an integral part of member 12.

Member 12 further comprises a manifold 20 that is disposed so as to be spaced below elbow 18. Manifold 20 contains a centrally located mounting flange 22 that is co-axially juxtaposed to a mounting flange 24 at the terminus of elbow 18. It is between elbow 18 and manifold 20 that a throttle body 26 of the present invention is disposed to provide a fluid-tight continuation for the induction air flow from the elbow to the manifold.

To either side of mounting flange 22, there are two runners leading from the manifold to individual cylinders of the engine, runners 28 and 30 on the left as view in FIG. 1 and runners 32 and 34 on the right. Associated with each runner is an electromechanically operated fuel injector 36 that is poised to inject fuel toward the intake valve(s) of the cylinder served by the corresponding runner.

Figure 3:
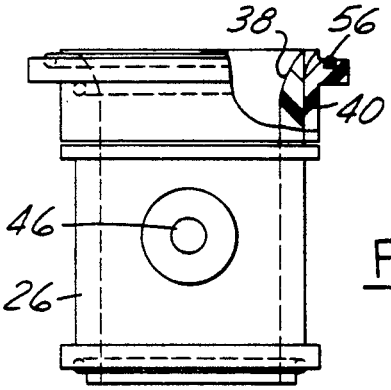
FIG. 3 is a side elevational view of the throttle body by itself in the telescopically contracted condition with certain portions broken away.
Figure 5:
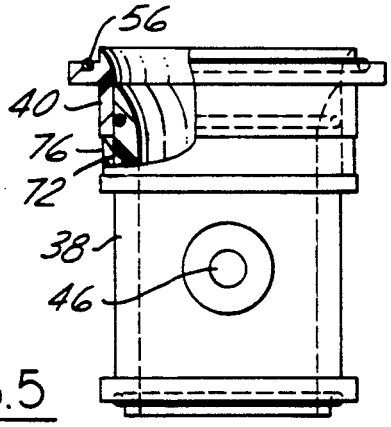
FIG. 5 is a view similar to the view of FIG. 3, but illustrating the telescopically expanded condition.

Further details of throttle assembly 26 can be seen in FIGS. 3–7. It comprises a throttle body having two telescopically engaged body parts 38 and 40. Body part 38 has a generally tubular shape comprising a bore 42 of circular cross section. Part 40 also has a generally tubular shape comprising a bore 43 and telescopes over the upper end of body part 38 as seen in FIGS. 2, 3 and 5. The throttle valve mechanism of throttle body 26 is contained in body part 38 and comprises a throttle blade 44 on a shaft 46 that is journaled in the wall of body part 38 and operated by means of an external lever 48 to set the amount of throttling.

Figs. 1 and 3 illustrate throttle body 26 with its two body parts 38, 40 in a telescopically contracted condition. In this condition, the overall axial dimension of the throttle body is less than the distance between mounting flanges 22 and 24 to allow throttle body 26 to be disposed between and in co-axial alignment with them. After having been so disposed, the two parts 38 and 40 are operated to telescopically expanded condition represented in FIGS. 2 and 5 wherein a flange 50 provided at the upper end of part 40, i.e. at the throttle body inlet, mates with mounting flange 24 and a flange 52 at the lower end of part 38, i.e. at the throttle body outlet, mates with mounting flange 22. In this condition, the entirety of bore 42 and that portion of bore 43 that is above the upper terminus of bore 42 provide a continuance of the induction passage from elbow 18 to manifold 20. Three O-ring seals are provided to assure proper sealing, and they are a lower O-ring seal 54 that seals the throttle body outlet end to mounting flange 22, an upper O-ring seal 56 that seals the throttle body inlet end to mounting flange 24, and an O-ring seal 58 that seals between the telescopically overlapping portions of body parts 38 and 40.

For properly circumferentially locating the throttle body assembly in installed position, a locating means is provided. This locating means comprises a pocket 60 in a wall 62 of member 12 directly behind the installed throttle body assembly and a complementary projecting formation 64 on the exterior of part 38. In this instance the pocket and complementary projection are rectangular in shape. As can be seen in FIG. 2, the projection 64 lodges in pocket 60 to provide the proper circumferential location of the throttle body in the installed position.

It is also desirable to provide a locking means for locking the two parts 38 and 40 in telescopically expanded condition. Such locking is accomplished in two ways, one by providing a locking catch mechanism, and two by providing a locking band, or collar. The locking catch mechanism takes the form of a radial arm 65 that projects radially outwardly from part 40 and a tab 66 that projects externally from wall 62. The lower face of arm 65 contains an integral headed stud 68 and the distal end of tab 66 contains a forked receptacle 70 for receiving the shank of stud 68. When the throttle body is in the process of being assembled into the induction system, arm 65 is disposed approximately in the position shown in FIG. 1 so as to be in a non-interference relationship with tab 66. Once the telescopically contracted body parts 38, 40 have been placed in co-axial alignment with mounting flanges 22 and 24, the two body parts can be telescopically expanded without arm 65 interfering with tab 66. After the throttle body has been telescopically expanded, part 40 is rotated in a counterclockwise sense as viewed in FIG. 1 to bring arm 65 into overlying relationship with tab 66 and concurrently cause the shank of stud 68 to be received in receptacle 70 in a snap-catch fashion. With the two body parts telescopically expanded, there exists a space 72 between the lower edge of part 40 and a flange 74 extending around the exterior of part 38. A resiliently expansible collar or band 76, of slightly more than semi-circular extent, is inserted over body part 38 in this space to provide an interference between the lower edge of body part 40 and flange 74 which prevents the two body parts from being telescopically contracted.

Figure 8:
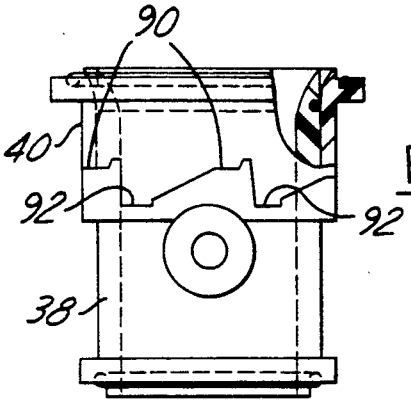
FIG. 8 is a view similar to the view of FIG. 3, but illustrating another embodiment of throttle body in the telescopically contracted condition.
Figure 9:
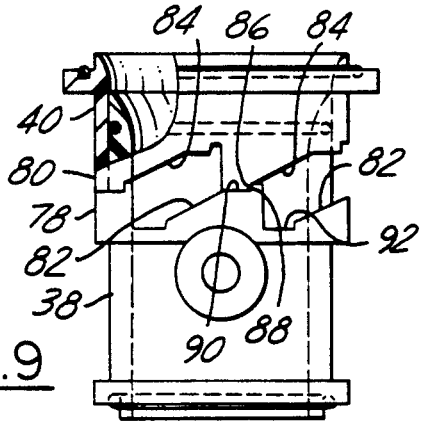
FIG. 9 is a view similar to the view of FIG. 8, but illustrating the throttle body in the telescopically expanded condition.

FIGS. 8 and 9 illustrate a second embodiment of throttle body in which the same reference numerals are used to designate the same parts that were previously described in connection with the first embodiment. The embodiment of FIGS. 8 and 9 differs from the first embodiment in that the two body parts 38 and 40 comprise respective camming means 78 and cammed means 80. The camming means and cammed means are fashioned in respective confronting surfaces 82, 84 of the two parts which extend around the exterior of each. In the telescopically contracted condition of FIG. 8, the surfaces rest against each other in a congruent manner. The two parts are operated from the telescopically contracted condition to the telescopically expanded condition by relatively rotating the two parts in opposite directions about their co-axis. The sliding motion of the one cam surface along the other creates the telescopic expansion. Respective abutment stops 86, 88 are provided in the two parts to define the limits at which full telescopic expansion is reached. Camming means 80 is provided with respective detents 90, 92 that define the respective conditions of telescopic expansion and telescopic contraction.

While a presently preferred embodiment of the invention has been illustrated and described, it should be appreciated that principles of the invention are applicable to other embodiments which are equivalent to the following claims.

What is claimed is:

1. An internal combustion engine induction system comprising throttle means for selectively throttling the induction flow into the engine characterized in that said throttle means comprises throttle body means having selectively operable throttle valve means and in that said throttle body means comprises axially telescopically engaged parts that are selectively operable to a relatively telescopically contracted condition that enables said throttle means to be assembled into the induction system and to a relatively telescopically expanded condition that, after said throttle means has been assembled into the induction system, prevents said throttle means from being disassembled from the induction system unless said parts are operated to said relatively telescopically contracted condition.

2. An internal combustion engine induction system as set forth in claim 1 including locking means positively locking said parts in relatively telescopically expanded condition with said throttle means assembled into the induction system.

3. An internal combustion engine induction system as set forth in claim 2 in which said locking means comprises mutually engaged locking portions, one on one of said parts and another on a portion of the induction system other than said parts.

4. An internal combustion engine induction system as set forth in claim 2 in which said locking means comprises a member separably mounted on said throttle body means and providing between said parts, with said parts in said relatively telescopically expanded condition, mechanical interference that prevents said parts from being operated to said relatively telescopically contracted condition.

5. An internal combustion engine induction system as set forth in claim 1 in which said parts comprise camming means and cammed means that are operatively related to cause said parts to operate from said relatively telescopically contracted condition to said relatively telescopically expanded condition upon relative rotation between said parts about a coaxis of said parts.

6. An internal combustion engine induction system as set forth in claim 5 including detent means defining said relatively telescopically contracted condition and said relatively telescopically expanded condition.

7. An internal combustion engine induction system as set forth in claim 1 including O-ring sealing means between said parts.

8. An internal combustion engine induction system as set forth in claim 1 in which said induction system comprises a member having spaced apart coaxial flanges between which said parts are disposed when in said telescopically expanded condition, and sealing means disposed between said parts and said flanges.

9. An internal combustion engine induction system as set forth in claim 8 including locating means for locating one of said parts that contains said throttle valve means circumferentially relative to said member.

10. An internal combustion engine induction system passage means containing throttle valve means for selectively throttling the induction flow into the engine characterized in that said passage means comprises axially telescopically engaged parts that are selectively operable to a relatively telescopically contracted condition that enables a portion of said passage means containing said parts to be assembled into the induction system and to a relatively telescopically expanded condition that, after said portion has been assembled into the induction system, prevents said portion from being disassembled from the induction system unless said parts are operated to said relatively telescopically contracted condition.

11. An internal combustion engine induction system passage means as set forth in claim 10 in which said induction system comprises a member having spaced apart coaxial flanges between which said parts are disposed when in said telescopically expanded condition, and sealing means disposed between said parts and said flanges.

12. A method of making an internal combustion engine induction system having throttle means for selectively throttling the induction flow into the engine, said throttle means having throttle body means having axially telescopically engaged body parts and containing selectively operable throttle valve means, said parts being selectively operable to a relatively telescopically contracted condition that enables said throttle means to be assembled into the induction system and to a relatively telescopically expanded condition that, after said throttle means has been assembled into the induction system, prevents said throttle means from being disassembled from the induction system unless said parts are operated to said relatively telescopically contracted condition, said method comprising disposing said throttle body means between spaced apart flanges of the induction system with said parts in said telescopically contracted condition, and then operating said parts to said telescopically expanded condition to engage said flanges such that said throttle means is prevented from being disassembled from the induction system unless said parts are operated to said telescopically contracted condition.

13. A method as set forth in claim 12 including the step of positively locking said parts in relatively telescopically expanded condition with said throttle means assembled into the induction system.

14. A method as set forth in claim 12 in which the step of operating said parts from said relatively telescopically contracted condition to said relatively telescopically expanded condition comprises relatively rotating said parts about a coaxis of said parts to cause interaction between camming means and cammed means on said parts that causes said parts to operate from said relatively telescopically contracted condition to said relatively telescopically expanded condition.

15. A method as set forth in claim 12 including the step of locating one of said parts that contains said throttle valve means circumferentially relative to one of said flanges.

* * * * *